US010843499B2

(12) United States Patent
Talwerdi et al.

(10) Patent No.: US 10,843,499 B2
(45) Date of Patent: Nov. 24, 2020

(54) PRINTER FOR OFFICIAL DOCUMENTS

(71) Applicant: SICPA HOLDING SA, Prilly (CH)

(72) Inventors: Mehdi Talwerdi, North Vancouver (CA); Winfield Fisher, Maple Ridge (CA); Bahador Sohrabi, Vancouver (CA); Ion Toma, Maple Ridge (CA); Vincent Nan, Oakville (CA)

(73) Assignee: SICPA HOLDING SA, Prilly (CH)

( * ) Notice: Subject to any disclaimer, the term of this patent is extended or adjusted under 35 U.S.C. 154(b) by 0 days.

(21) Appl. No.: 16/328,218

(22) PCT Filed: Aug. 24, 2017

(86) PCT No.: PCT/EP2017/071299

§ 371 (c)(1),
(2) Date: Feb. 25, 2019

(87) PCT Pub. No.: WO2018/037066

PCT Pub. Date: Mar. 1, 2018

(65) Prior Publication Data

US 2019/0210395 A1 Jul. 11, 2019

(30) Foreign Application Priority Data

Aug. 25, 2016 (EP) ..... 16185710

(51) Int. Cl.
*B42D 25/24* (2014.01)
*B41J 3/28* (2006.01)
(Continued)

(52) U.S. Cl.
CPC ..... *B42D 25/24* (2014.10); *B41J 3/283* (2013.01); *B41J 11/20* (2013.01); *B41J 13/12* (2013.01);
(Continued)

(58) Field of Classification Search
CPC ..... B42D 25/24
(Continued)

(56) References Cited

U.S. PATENT DOCUMENTS

2009/0309534 A1* 12/2009 Harris ..... B41J 11/42 318/685
2011/0242171 A1* 10/2011 Zhang ..... B41J 2/04581 347/10
(Continued)

FOREIGN PATENT DOCUMENTS

CN 101171133 4/2008
DE 102006031024 1/2008
(Continued)

OTHER PUBLICATIONS

International Search Report and Written Opinion issued with respect to application No. PCT/EP2017/071299.
(Continued)

*Primary Examiner* — Allyson N Trail
(74) *Attorney, Agent, or Firm* — Muncy, Geissler, Olds & Lowe, P.C.

(57) ABSTRACT

The present invention provides a printer for applying a stamp onto an official document, wherein the printer comprises an access level with an inlet for inserting the document into and removing the document from the printer, a processing level including a print head, and an inter-level document transport system for moving a document receiving platen between the access level and the processing level. The access level and the processing level are at least partly arranged on top of each other. The present invention also provides an imaging system for a printer and a method for processing an official document with a printer.

20 Claims, 13 Drawing Sheets

(51) Int. Cl.

| | |
|---|---|
| ***B41J 11/20*** | (2006.01) |
| ***B41J 13/12*** | (2006.01) |
| ***G07C 9/25*** | (2020.01) |
| ***B42D 25/305*** | (2014.01) |
| ***B41M 3/14*** | (2006.01) |
| ***G07D 7/00*** | (2016.01) |

(52) U.S. Cl.
CPC ..... *B41M 3/14* (2013.01); *B42D 25/305* (2014.10); *G07C 9/257* (2020.01); *G07D 7/00* (2013.01); *B65H 2701/1926* (2013.01)

(58) Field of Classification Search
USPC ..... 235/384, 381, 380, 379
See application file for complete search history.

(56) References Cited

U.S. PATENT DOCUMENTS

| | | | | |
|---|---|---|---|---|
| 2014/0020576 | A1 | 1/2014 | Ortmann et al. | |
| 2018/0022130 | A1* | 1/2018 | Matsuda | B41J 3/4075 347/16 |
| 2020/0090471 | A1* | 3/2020 | Beskitt | B65H 3/5253 |

FOREIGN PATENT DOCUMENTS

| | | |
|---|---|---|
| DE | 102006061214 | 1/2008 |
| EP | 0599218 | 6/1994 |
| EP | 1520715 | 8/2007 |
| EP | 2518696 | 10/2012 |
| EP | 3015270 | 5/2016 |
| JP | 4473933 | 6/2010 |
| WO | 2006083521 | 8/2006 |
| WO | 2006120156 | 11/2006 |
| WO | 2008064867 | 6/2008 |
| WO | 2014180840 | 11/2014 |
| WO | 2015058948 | 4/2015 |

OTHER PUBLICATIONS

International Preliminary Report on Patentability issued with respect to application No. PCT/EP2017/071299.

Chinese Office Action in counterpart Chinese Application No. 201780040549.5 dated Mar. 23, 2020 (and English language translation of the Office Action).

* cited by examiner

PRINTER FOR OFFICIAL DOCUMENTS

TECHNICAL FIELD

The present invention relates to a printer for official documents, in particular traveling documents such as passports. Further, the invention relates to an imaging unit for a printer for registering an image of at least a part of an official document. The invention also relates to a method of applying a stamp, such as a visa stamp, to such documents.

BACKGROUND OF THE INVENTION

Offices and in particular public offices often have to add and/or change information to existing official documents. In many instances this is still done manually. For example, stamps such as entry or exit stamps as well as visa are applied to passports using physical rubber stamps. However, manually applied rubber stamps greatly differ in quality and due to a lack of security features leave room for illicit transformation.

Visa may also be applied to a passport in the form of a separate sheet that is often prepared in advance. Applying for a visa may even require sending in a passport to a consulate or an embassy long before traveling. For visa that do not require a separate application, visa sheets have to be produced and be securely transferred to the place of issue and are, thus, also vulnerable to manipulation. Moreover, personnel or officers applying the stamps or visa report of health problems like typewriter's cramp, etc.

As a result and as alternative to manually applied stamps, printers for printing these stamps on official documents have been made commercially available. EP 1 520 715 B1 describes for example a printer for printing on travel documents. Similarly, WO 2014/180840 A1 discloses an apparatus and method for reading a document, in particular travel documents like passports, and printing a mark or stamp thereon.

Further, existing printers are large and generally require more time to print on an official document than it takes for a stamp to be manually applied using a rubber stamp. The large size of these printers is disadvantageous since in relation to printing on traveling documents, the booths for the border officials are often rather small. Also, in case of malfunction, these printers cannot easily be replaced.

SUMMARY OF THE INVENTION

It is therefore an objective of the present invention to provide a printer for official documents, in particular traveling documents such as passports, that can apply a stamp, such as a visa stamp, or marking quickly and conveniently.

Another objective is to provide a printer that is compact and has a foot print that easily fits on a desk.

Yet another objective is to prevent manipulation from outside the printer. Further, it is desirable to check an official document or a stamp thereon before and/or after printing.

In view of these objectives, the present invention provides a printer for applying a stamp onto an official document, wherein the printer comprises an access level with an inlet for inserting the document into and removing the document from the printer, a processing level including a print head, and an inter-level document transport system for moving a document receiving platen between the access level and the processing level. The access level and the processing level are at least partly arranged on top of each other.

The subdivision of the printer into an access level and a processing level has the advantage to ensure that processing of the document can take place without manipulation from outside the printer. For example, manipulation may occur by an operator of the printer who holds on to the document while processing is taking place. This is a common feature of prior art devices intended for official documents and bears the risk of the documents not being kept sufficiently still while being processed so that the processing result ends up with an unsatisfactory quality. As the skilled person will appreciate in relation to security features, the higher the quality of the print the more advanced the security features can be.

A stamp in relation to this invention is a lasting imprint to be printed onto an official document and is not limited to a seal. Thus, a stamp in relation to this invention is to be understood as an image to be applied to an official document that could comprise a seal, an alphanumeric character, an alphanumeric code, a picture, a bar code, encrypted imaging, etc. or any combination thereof.

In the printer according to the present invention, manipulation after insertion of the official document into the inlet is prevented by moving the official document that is placed on the document receiving platen further into the printer, i. e. from the access level to the processing level, using the inter-level document transport system.

The document is preferably inserted into the inlet of the printer with an edge of the document first. After insertion, the inter-level document transport system changes the direction of movement to a direction the flat side of the document faces, which is preferably substantially perpendicular to the flat side. As a result of this movement, processing of the document takes place practically inaccessible on top of or below the access level.

Also, using a document receiving platen to move the document has the advantage that after insertion into the printer and placement of the document on the platen, the movement of the document through the printer is defined by the movement of the platen. More specifically, moving the document indirectly by driving the platen generates a more defined and predictable trajectory of movement than directly driving the document, for example by transporting the document with rolls. This specifically applies to documents with wear marks or documents that are bent.

Further, the subdivision within the printer into a first space representing the access level and a second space on top or below the first space representing the processing level allows the printer to have a smaller footprint. Despite the smaller footprint and due to this arrangement, there is also sufficient space for providing the printhead or even additional features for processing the official document, as will be defined further below in relation to preferred embodiments of the invention. In other words, the arrangement of features also facilitates a more compact and, thus, space efficient design of the printer.

In an embodiment of the printer, the inter-level document transport system is a pulley mechanism comprising at least one pulley connected to a motor, preferably a stepping motor.

Employing a pulley mechanism as inter-level document transport system provides for a simple and reliable mechanism for moving the document platen. In particular in combination with a stepping motor, the mechanism allows for a precise positioning of the document receiving platen on a predetermined level. The pulley mechanism in combination with the platen is also able to provide feedback about the position of the document due to the direct mechanical engagement between these components. Preferably, a pulley system is employed, in which one end of a clamp belt runs over and is fixed to a pulley and the other end of the belt is fixed, preferably to the document receiving platen. The belt may also be a rope or a cable and may run over at least one additional pulley between its two ends.

In a preferred embodiment, the inter-level document transport system includes at least one spring biasing the document receiving platen preferably towards the processing level.

In this embodiment, the pulley system can be positioned with particular high precision due to constant tension in the belt of the system that is caused by the springs biasing the document receiving platen.

Further, the springs biasing the inter-level document transport system towards one of the two end positions, namely the access level or the processing level predetermines the position, where the document platen is located while the drive of the pulley system is not activated. In this respect, biasing the document receiving platen towards the access level has the advantage of the document being accessible for removal from the printer in case of a malfunction of the inter-level document transport system. However, a bias towards the processing level holds the document receiving platen in the correct position for being processed without having to constantly control the drive of the inter-level transport system to keep the platen in a steady position.

In another preferred embodiment, the inter-level document transport system comprises a plurality of springs for biasing the document receiving platen, wherein the pulley mechanism is preferably attached to one attachment point at the document receiving platen, the attachment point even more preferably being located between the springs.

This configuration achieves a particular balanced bias of the document receiving platen due to the plurality of springs acting on different locations of the platen. This effect can be further enhanced by locating the attachment point between the springs.

In yet another embodiment, the printer further comprises an intra-level document transport system including a motor, such as a stepping motor or DC-motor, and a linear transfer mechanism, such as a gear rack, a lead screw or an endless belt, the linear transfer mechanism being connected to the document receiving platen, wherein the linear transfer mechanism is preferably indirectly connected to the document receiving platen via the inter-level document transport system.

The intra-level document transport system supports an operator during insertion of the official document. It may also give feedback to the operator by automatically starting to transport the official document on the access level when the printer registers that the document is placed on the document receiving platen. This also avoids a misplacement of the document on the document receiving platen since the intra-level document transport system allows for a movement of the document further into the printer so that unintended manipulation of the document on the platen can be avoided, which may result in the inter-level transport mechanism getting stuck. The use of a motor and a linear transfer mechanism for moving the document receiving platen has the advantage of a precise and responsive control of the platen's intra-level position.

The linear transfer mechanism transforms the rotary movement of the motor in a linear movement for moving the intra-level document transport system. The document transfer mechanism preferably uses a gear rack, a lead screw and/or an endless belt for this transformation. In another embodiment, instead of a motor and a linear transfer mechanism a linear actuator such as a linear motor is used to move the document receiving platen.

The linear transport mechanism being optionally connected to the document receiving platen via the inter-level transport system has the advantage that the intra-level transport system is able to move the document along both the access level as well as the processing level. For example, on the processing level the intra-level transport system may be used to move the document relative to the print head of the printer.

In another embodiment, the document receiving platen has an edge facing the inlet for abutting the leading edge of the official document in the direction of insertion and preferably a sensor at this edge of the document receiving platen for sensing contact of the official document's leading edge.

An edge is an efficient way to give feedback to an operator inserting a document by acting as a rigid backstop. It does not only indicate how far the document is to be inserted so that the transport system of the printer can be activated but can also indicate the correct placement of the document on the document receiving platen.

If a sensor is present for sensing the leading edge of the official document, it can reliably provide the printer with the information needed to activate the document transport system. This can also enhance the feedback to an operator who places the official document on the document receiving platen by giving a signal such as activating transport once the document is placed correctly.

In yet another embodiment, the access level is located below the processing level.

This provides a comfortable insertion height for the document since the inlet of the printer will be approximately on the height of the desk surface an operator will work on. In this embodiment, the height of the inlet is independent of the needed space for the features implemented in the printer since these are located on the processing level of the printer, where plenty of space can be provided without changing the printer's footprint.

In another embodiment, the platen comprises a clamping means configured to clamp the official document on the document receiving platen for processing the document on the processing level.

The clamping means hold the document in place during processing in order to ensure a high quality processing of security features that have been or are to be applied onto the official document. Preferably, clamping only occurs after the document is fully inserted, for example, as sensed by the sensor from above for sensing the leading edge of the document.

Also, clamping may be executed by activating the inter-level transport system and moving the document on the document receiving platen so that the document is clamped between the document receiving platen and clamping means such as a clamp plate. Nonetheless, other clamping means may be employed as will be described further below in more detail.

In one embodiment, the printer further comprises an imaging system including a camera arranged for registering an image of the official document on the processing level.

This camera enhances the ability of the printer to process official documents and may have at least any one of the following functions. One function of registering an image of the official document is the ability to determine the correct position on the document for applying a stamp, i. e. to perform quality control. The camera may additionally or alternatively be used to verify a stamp or the application of a stamp. In this respect, taking an image of the official document can also serve other verification purposes to determine the validity of this document. Further, the camera may be used for data logging, data mining, profiling, self-calibration, etc.

In a preferred embodiment, the imaging system further comprises a mirror arranged on an optical path between the camera and the platen.

The arrangement of a mirror allows to increase the length of the optical path between the camera and the document receiving platen. More specifically, the mirror allows to redirect the optical path between the camera and the platen allowing to make optimum use of space and as a result to avoid an increase of the printer's size. Further, by lengthening the optical path, the quality of imaging is increased.

In a particular preferred embodiment, the printer further comprises an illumination unit arranged for illuminating the official document and/or treating a stamp applied to the document.

This illumination unit can have various functions. The illumination unit may provide optimum lighting conditions for registering an image, provide light with a particular wavelength and/or polarization adapted to visualize security features of an official document, and/or assist in processing a stamp, e. g. drying the stamp after printing.

In yet another embodiment, the illumination unit comprises at least two different light sources.

In this embodiment, any of the previously described functions can more easily be realized in combination by designating different light sources to different functions.

In another embodiment, the printer further comprises an inlet light and/or an entry sensor arranged at least partly around the inlet.

The inlet light source can be used to give visual feedback to an operator such as that the official document has reached its predetermined position on the document receiving platen. Alternatively or additionally, the inlet light source can signal to an operator when the official document can be removed from the document receiving platen. Likewise, the inlet light source can also be used to signal to an operator that the printer is ready to receive the document or that an error has occurred.

The inlet sensor enables the printer to sense the presence of the official document at the inlet of the printer. This can be used to prepare the transport mechanism and/or to activate the processing means for the document. For example, the inter-level transport mechanism can be moved to the access level of the printer. The inlet sensor may also be configured to register the width of the document entering the inlet and allows, for example, to give feedback to an operator if the document has been correctly inserted into the printer, to help identifying the document, or to determine an area, where a stamp can be applied.

The invention further provides an imaging system comprising a camera for registering an image of an official document and a mirror, the mirror being arranged on an optical path between the camera and the official document located on a document receiving platen.

Such an imaging system is able to quickly register an image of a whole document at once without the need for wide-angle lenses that tend to distort the image. The reason is that the mirror increases the length of the optical path between the camera and the official document. This configuration of the image unit is in particular intended for a printer as embodied in one of the embodiments described above. Further, the imaging system saves processing time compared to a scan of the document since the image of the document is registered in one go.

In a preferred embodiment of the imaging system, the imaging system further comprises an illumination unit arranged for illuminating the official document and preferably being arranged around the optical path.

The illumination unit may be configured as already described above for the illumination unit of the printer. Further, arranging the illumination unit around the optical path between the camera and the document receiving platen, where the official document is to be placed, results in a particular uniform illumination of the document. This is particularly advantageous for verification purposes.

The invention also provides a method for processing an official document with a printer, in particular a printer as described in one of the embodiments above. The method comprises the steps of inserting an official document into an inlet on an access level of the printer and placing the document on a document receiving platen, moving the official document on the document receiving platen from the access level to a processing level using an inter-level transport mechanism, printing a stamp onto the official document, and moving the official document from the processing level to the access level for removal of the document from the inlet of the printer.

This method of processing an official document is fast and efficient. It is also secure since taking the processing of the document to another level, i. e. the processing level, within the printer after insertion of the document prevents access of an operator to the document during processing. This separation of entry and exit of the document on the one hand and processing of the document on the other hand also protects the operator from the processing means such as fumes due to printing or UV-light that may be used to register features of the official document. As already described above, the method of transporting the document on a document receiving platen between levels also results in a smaller footprint of the device.

In an embodiment, the method further comprises the steps of registering an image of the official document using a camera and preferably a mirror located on an optical path between the camera and the official document and processing the registered image for determining the location for a stamp and/or verifying a stamp.

Registering an image for determining the location for a stamp and/or for verifying a stamp using a camera allows for a particularly fast determination in comparison to other techniques such as manual determination by an operator before insertion or a scan of the document.

In an embodiment, the method comprises the step of moving the official document on the platen by an intra-level document transport system after insertion of the document into the inlet and preferably before moving the document receiving platen with the inter-level document transport system.

This embodiment facilitates insertion of a document into the printer since the transport to a location that allows for activating the inter-level transport system partly happens automatically by the intra-level transport system. Also, it is easier to dispense the document from the printer.

In another embodiment, the method further comprises the step of moving the platen on the processing level using the intra-level document transport system while processing the document.

This is particularly advantageous if a stamp has to be applied over an area that is larger than the printhead. In such a case, the intra-level transport mechanism can move the official document located on the document receiving platen underneath the print head.

In another embodiment of the method, the step of printing a stamp comprises printing a dynamic stamp based on dynamically generated data.

This is a particular advantage of using the visa printer. Since the printer is flexible concerning what is printed, the stamp can be adapted according to specific data related to the holder of the official document. This significantly enhances the security of the stamp.

BRIEF DESCRIPTION OF THE FIGURES

The following figures illustrate preferred embodiments of the present invention. These embodiments are not to be construed as limiting but merely to enhance the understanding of the invention together with the following description. In these figures, same reference signs refer to features throughout the drawings that have the same or an equivalent function and/or structure. In the drawings accompanying this application.

DETAILED DESCRIPTION OF PREFERRED EMBODIMENTS

Figure 1:
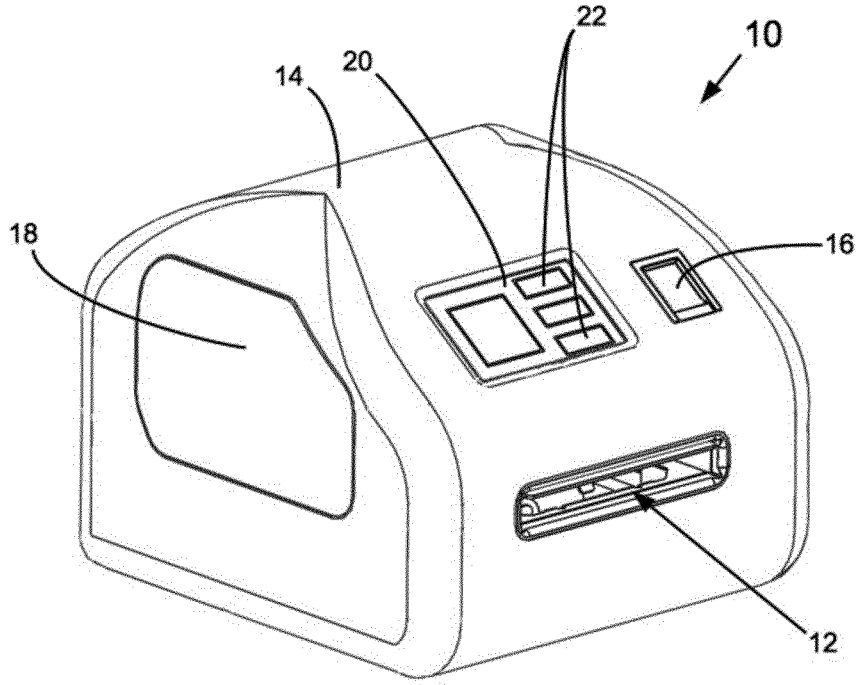
FIG. 1 is a three-dimensional view of a printer according to an embodiment for applying a stamp onto an official document.

Referring to FIG. 1, a compact printer for printing on documents, like travel documents, i.e. passports is shown generally at 10. Although it will generally be referred to the document as being a passport in the detailed description below, the term document is to be understood as being an official document on which a stamp is applied in relation to an official act.

In variations, the printer 10 may be operable to print also on other types of documents, including single sheets of paper; multiple, unbound stacks of paper, multiple bound stacks or pads of paper, cards, including plastic cards and identity cards, other document-like objects (e.g. wood plaques); and any combination thereof for example.

Any of these documents have a flat side containing information and edges surrounding the flat side. The printer 10 prints on the flat side of the document.

The printer 10 includes at its front an inlet 12 for receiving documents, such as a passport (not shown in FIG. 1), into an interior of the printer 10 that is ordinarily covered by an exterior body 14. The passport being inserted is typically open to a page on which a stamp/visa, etc. may be printed.

The printer 10 includes preferably a biometric reader, such as the fingerprint scanner 16 shown in FIG. 1. The fingerprint scanner 16 is operable to capture an image or other representation of a fingerprint when a fingertip is placed against the fingerprint scanner 16 window. In some embodiments, a fingerprint representation is captured as soon as a finger is placed against the fingerprint scanner 16 whenever the fingerprint scanner 16 is powered and has been activated. In some embodiments, the fingerprint scanner 16 is operable to sense the presence of an object placed adjacent to the fingerprint scanner 16 and then self-activate to capture the representation. The fingerprint scanner is typically used by an operator (e.g. government Official) of the printer 10 during a login procedure prior to using the printer 10 for printing.

The printer 10 includes an access, i.e. a door 18 for accessing an ink cartridge inside the printer 10. Typically, the door 18 is opened to inspect or replace one or more ink cartridges of the printer 10. The door 18 is electronically controlled and can be electronically opened only after providing security credentials (e.g. login password).

The printer 10 includes preferably also a display 20, which may be a liquid crystal display (LCD) for example. The display 20 is a touchscreen display that is operable to receive user input by the operator touching a soft button or other icon displayed on the display 20.

FIG. 1 also shows soft buttons 22 displayed on the display 20 during a wait state of the printer 10. The soft buttons 22 appear immediately after the operator has logged in to use the printer 10. By way of example, the soft buttons 22 may include an eject button for ejecting a document from inside of the printer 10, an ink change button for opening the door 18, an information button for displaying additional information related to the printer 10, and other possible soft buttons 22. Such additional information may include model and make of the printer 10, serial number, and software version number, for example. Instead of soft buttons any other type of button may be used.

In the embodiment shown in FIG. 1, the printer 10 is operable to display a plurality of context-specific menus, such as display menus related to the fingerprint scanner 16, printing operations, general settings, maintenance features, and others. Status indications and error messages may be displayed on the display 20. In some embodiments, the menus that are displayed depend on the identification of the particular user (or user's group) that is logged in to the printer 10. For example, logging in as administrator may result in a different set of menus being displayed on the display 20 than logging in without administrator privileges. The printer 10 is multi-lingual such that it is operable to display text on the display 20 in a selectable one of a plurality of languages. The displayed language may depend on the identification of the user (or user's group).

The inlet 12 in some embodiments includes lights around the opening of the inlet 12, to facilitate viewing of the inlet 12 and in some embodiments to provide status information. For example, lighting at the inlet 12 may be colored green to indicate the printer 10 is ready to receive a document, red to indicate that a document should not be inserted into the inlet 12 (e.g. the printer 10 is not ready, or a document has already been inserted and not yet removed), or other colors for example. Additionally, or alternatively to indicating an error message on the display 20 and/or producing a sound (e.g. error-indicating beep), the lighting at the inlet 12 may flash to indicate an error, for example. Although it is preferred to arrange the lights around the opening of the inlet, other arrangements are conceivable such as placing at least one light at one of the sides of the inlet 12, preferably the upper or lower side.

The body 14 may have a variety of shapes and compact sizes. For example, FIG. 2 shows the rear of an embodiment of the printer 10 whose body 14 has more rounded corners than the embodiments shown in FIG. 1.

Figure 2:
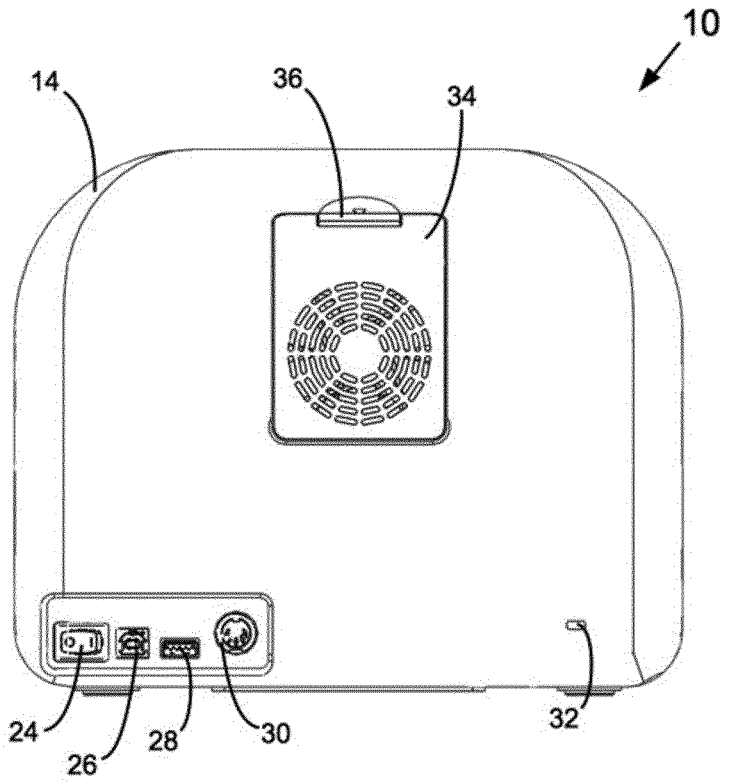
FIG. 2 illustrates the backside of the printer shown in FIG. 1.

As can be seen in FIG. 2, the printer 10 includes according to a preferred embodiment of the invention a power switch 24 operable to turn power on and off to the printer 10, an interface such as a type-A universal serial bus (USB) receptacle 26 for receiving a USB cable to connect the printer 10 as a peripheral device of a Personal Computer (PC), another interface such as a type-B USB receptacle 28 for receiving a USB cable dimensioned for being connected between the printer 10 and a peripheral device (not shown) of the printer 10, and a power input receptacle 30 for receiving electrical power, such as alternating current (AC) electrical power or direct current (DC) electrical power for example.

Additionally or alternatively to the USB receptacles 26 and 28, the printer 10 may include in some embodiments one or more receptacles or other connectors for connecting to a telecommunications network, such as a global telecommunications network (e.g. the Internet) or peripheral devices.

The printer 10 may also include a Kensington™ Security Slot 32 for receiving a Kensington™ style lock (not shown) for securing the printer 10 to a fixture.

Still referring to FIG. 2, the printer 10 preferably includes a fan door 34 having a latch 36 that can be unlatched for pivoting the door 34 open. Opening the door 34 provides access to a fan filter that can be replaced or otherwise serviced. In some embodiments, the latch 36 is lockable and may include an electronically-controllable lock. In some embodiments, the printer 10 fan is always on whenever electrical power is being supplied to the printer 10. However, in other embodiments, the printer 10 fan operation is electronically controlled, such as by software in response to user input and/or being automatically determined by a software algorithm in response to any one or more of a pre-determined duty cycle, an indication of temperature, an indication of a quantity of ink duct or other forms of dust, or other factors.

Figure 3:
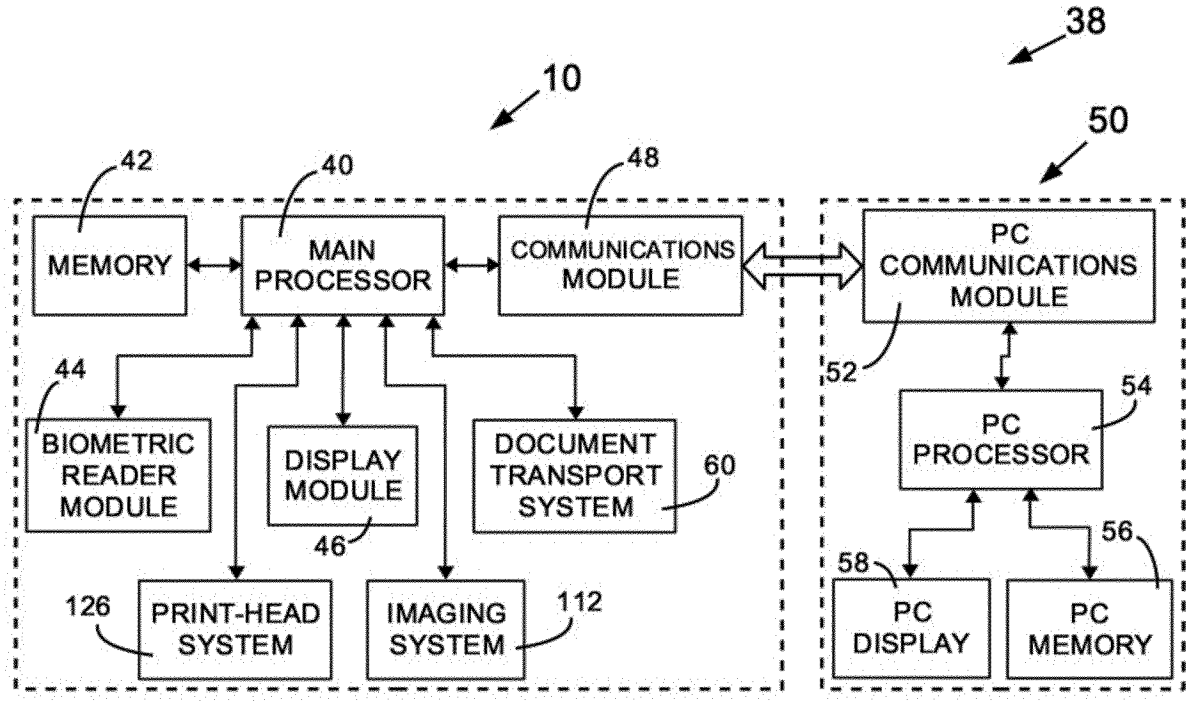
FIG. 3 is a block diagram illustrating various modules of a printer according to an embodiment for processing an official document.

FIG. 3 shows a block diagram of a preferred embodiment of a printing system 38 for printing on a document, such as printing for example stamps on passports (not shown in FIG. 3). The printing system 38 includes the printer 10, which includes a main processor 40 and a main memory 42. The printer 10 is operable to maintain an activity log of main processor events and memory events. Several auxiliary processors and auxiliary memory units are included in other system components described below.

The main processor 40 is typically a central processing unit (CPU), and may be implemented by one or more integrated circuits (IC) for example. The memory 42 is operable to store digital representations of data and other information, including storing program code for directing operations of the main processor 40 to perform steps of a method in accordance with the present invention. The memory 42 may be implemented as read-only memory (ROM) or similar, for example.

Still referring to FIG. 3, the printer 10 includes according to the shown preferred embodiment a biometric reader module 44 for controlling a biometric reader such as the fingerprint scanner 16 (FIGS. 1 and 2). The biometric reader module 44 includes a processor (not shown) and memory (not shown) for controlling operations of the fingerprint scanner 16 and for communicating with the main processor 40.

The printer 10 includes a display module 46 that includes a processor (not shown) and memory (not shown) for controlling operations of the display 20 (FIGS. 1 and 2) and for communicating with the main processor 40.

The communications module 48 is operable to effect communications between the printer 10 and a connected PC 50. In particular, the communications module 48 is operable to effect communications with a corresponding PC communications module 52 of the PC 50 via the type-A USB receptacle 26 (FIG. 2). Other communications modes, such as wireless communications, are also possible. The PC 50 includes the PC communications module 52, a PC processor 54, a PC memory 56, and a PC display 58 in a manner known in the art. The PC memory 56 stores program code for directing operations of the PC processor 54 to perform steps of a method in accordance with the present invention.

In the embodiment shown in FIG. 3, the printer 10 and the connected PC 50 form the printing system 38. The printing system 38 in some embodiments is operable to cause the printer 10 to transmit biometric data detected by the fingerprint scanner 16 to the main processor 40, which is operable to transmit such biometric data, via the communications module 48 and the PC communications module 52, to the PC processor 54 for display on the PC display 58, for example.

The communications module 48 is also operable to effect communications between the main processor 40 and a corresponding processor of a connected peripheral device (not shown) via the type-B USB receptacle 28 (FIG. 2).

Still referring to FIG. 3, the printer 10 includes a document transport system 60 for transporting a document, such as a passport (not shown in FIG. 3), received into the printer 10 via the inlet 12 (FIGS. 1 and 2).

As described in the summary of the invention, the document transport system 60 comprises an inter-level document transport system 8 and preferably an intra-level document transport system 9. Preferably, the movement path of the intra-level document transport system 9 or, if manually inserted, the movement path of insertion is substantially perpendicular to the movement path of the inter-level document transport system 8. In other words, in such a preferred embodiment, the inter-level document transport system 8 allows for a substantially vertical transport of the official document after insertion an preferably transport along a horizontal direction.

In the printer 10, the movement path of a document from insertion to processing is discontinuous, i. e. the change of direction of the geometric center of the document between intra-level transport (either manually or by a system) and inter-level transport happens abruptly and not gradually. This is in contrast to transport systems know from the prior art. Although in these transport systems a change in direction may occur, for example by arranging two endless belts adjacent and in an angle to each other, the change of direction of the geometric center happens gradually since while being transported from the first endless belt to the second endless belt, the edge of the document positioned on the first belt will still be supported by the first belt whereas the opposing edge is already positioned on the second belt. As a result, the geometric centre of the document is on a continuous curved path from the first belt to the second belt. Such a transport results in bending of the document, which may cause a misplacement of the document when transferring the document from one belt to the next belt. This problem occurs even more likely when using a row of adjacent rolls to transport a document in a printer.

The inter-level transport mechanism 8 moves the document receiving platen 68 between a lower position and a clamping position. The lower position corresponds to and is situated on the access level 1 and the clamping position corresponds to and is situated on the processing level 2. Further positions that correspond to the processing level 2 are, for example, the printing position and imaging position described in more detail further below.

Figure 4:
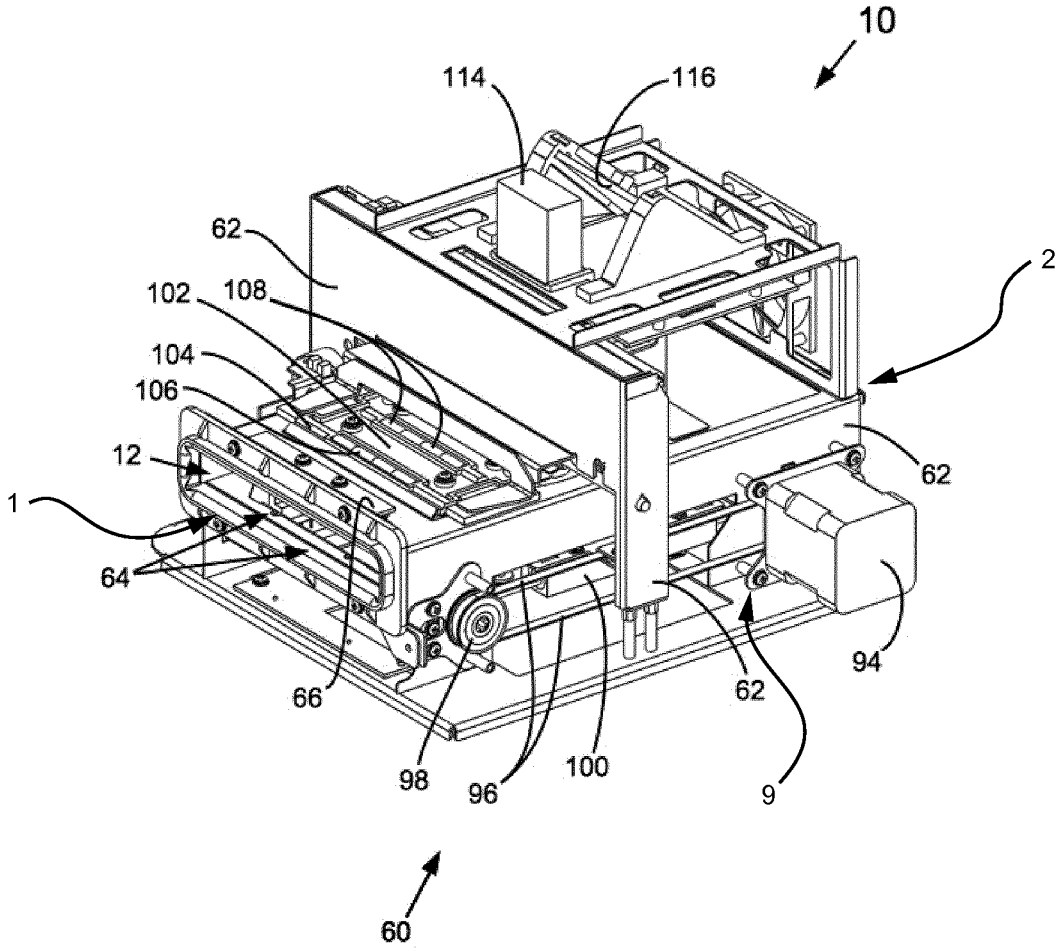
FIG. 4 is a three-dimensional view of a printer according to an embodiment with the outer case being removed for better visibility of the components inside the printer.

FIG. 4 shows internal components of the printer 10 according to a preferred embodiment, including a frame 62, that can be made visible by removing the exterior body 14 (FIGS. 1 and 2).

As can be seen in FIG. 4, the document transport system 60 of the printer 10 may include an entry sensor 64 for detecting the presence of an object, such as a document, at the inlet 12. In the embodiment shown in FIG. 4, the entry sensor 64 is implemented as an infrared source and a corresponding infrared detector disposed at opposing vertical ends of the inlet 12. The infrared source may be implemented as one or more light-emitting diodes (LEDs) mounted on the underneath of the printed circuit board (PCB) 66, for example. The corresponding infrared detector may be implemented as one or more photodiodes mounted below the inlet 12, for example.

While the embodiment shown in FIG. 4 shows the entry sensor 64 implemented as an infrared or optical sensor, in general any suitable entry sensor 64 may be employed, including a mechanical or other sensor for example. In some embodiments, the entry sensor 64 is integrated with lighting at the opening of the inlet 12. While FIG. 4 shows the entry sensor 64 disposed at opposing vertical ends of the inlet 12, additionally or alternatively the entry sensor 64 in some embodiments is disposed at opposing horizontal sides of the inlet 12. In some embodiments, the entry sensor 64 is operable to sense the width of a document being inserted through the inlet 12. In this case, the sensor may be configured to provide at least an indication, where a stamp is to be applied onto the document.

Figure 5:
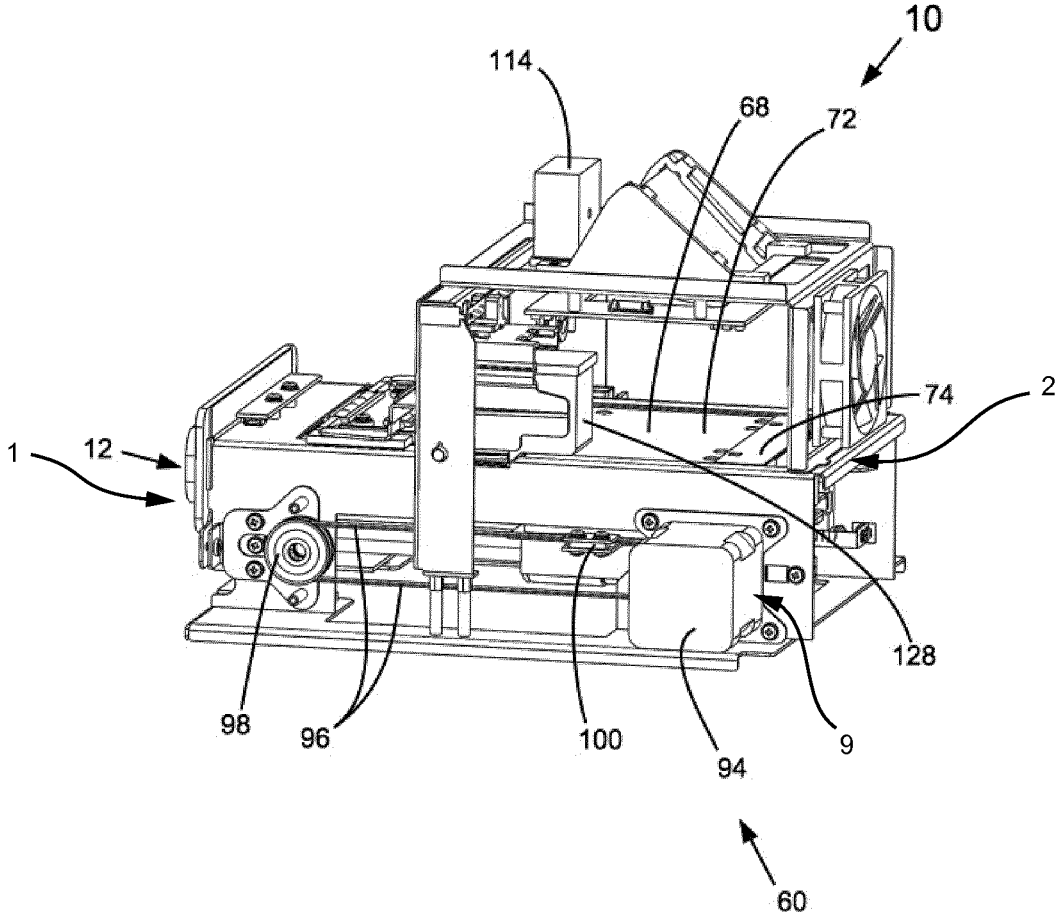
FIG. 5 is a three-dimensional side view of the printer illustrated in FIG. 4.
Figure 6:
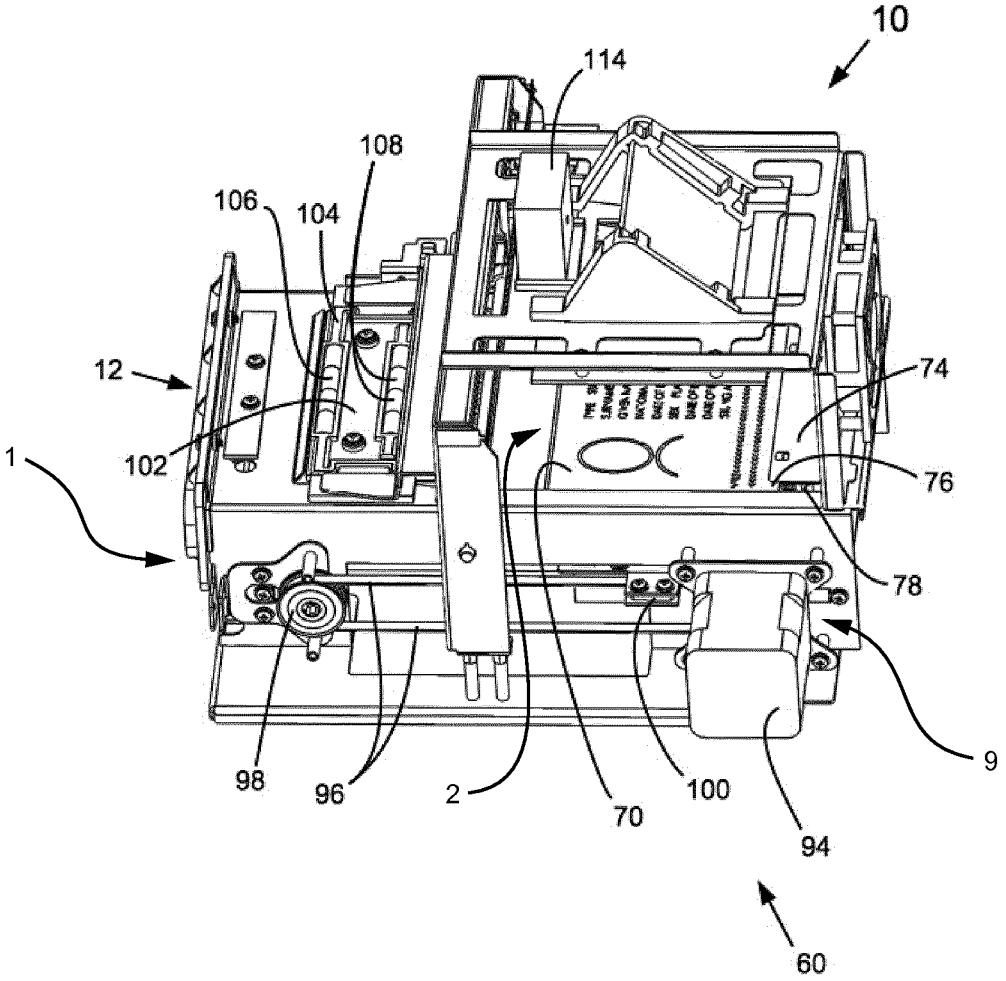
FIG. 6 is a three-dimensional side view in an oblique angle from above of the printer shown in FIGS. 4 and 5.

Referring to FIGS. 5 and 6, the document transport system 60 includes a platen 68 for supporting a document, such as the passport 70 shown in FIG. 6. In the exemplary embodiments shown in the Figures, the platen 68 is dimensioned to correspond to the size of one-half of a standardized booklet-type passport, thereby advantageously accommodating differences in thickness between the two halves of an opened booklet. In general, however, the platen 68 may be of any suitable dimensions. In some embodiments (not shown), the width and/or length of the platen 68 is adjustable, including possibly being user-adjustable. In some embodiments, the width of the platen 68 is automatically adjusted in response to an indication, such as may be produced by the entry sensor 64, of the width of the document being inserted through the inlet 12.

The platen 68 is operable to move vertically between upper and lower positions (inter-level transport mechanism). Preferably, in the upper position (processing level 2), the top surface 72 of the platen 68 is substantially aligned with the top of the inlet 12 when no document is present in the printer 10. In the exemplary embodiment shown, when the platen 68 is in its lower position (access level 1), the top surface 72 of the platen 68 is substantially aligned with or lower than the bottom of the inlet 12.

FIG. 5 shows the platen 68 in its upper position (processing level) contacting a clamp plate 74. FIG. 6 shows the passport 70, which is supported by the platen 68 (not visible in FIG. 6) in its upper position, contacting the clamp plate 74 at the leading edge 76 of the passport 70. When the platen 68 is in its lower position (access level), a gap is created between the platen 68 and the clamp plate 74 such that a document, such as the passport 70, can readily fit between the platen 68 and the clamp plate 74.

As shown in FIG. 6, the document transport system 60 includes a clamp sensor 78 for sensing when the leading edge 76 of the passport 70 is at a clamping position between the platen 68 and the clamp plate 74. In the embodiment shown in FIG. 6, the clamp sensor 78 is a mechanical sensor comprising a pair of contact switches disposed below the clamp plate 74 at opposing ends thereof. In general, however, any suitable clamp sensor 78 may be employed, such as an optical, infrared, other mechanical or other sensor for example.

The inter-level document transport system of the document transport system 60 is operable to clamp, between the platen 68 and the clamp plate 74, a document, such as the passport 70, at a central portion of the leading edge 76 of the document.

In the embodiment shown in FIGS. 5 and 6, both the top supporting surface 72 of the platen 68 and the bottom clamping surface (not visible in FIGS. 5 and 6) of the clamp plate 74 are preferably knurled, textured or otherwise non-slip surfaces to advantageously improve gripping of a document supported by the platen 68, including where clamped between the platen 68 and the clamp plate 74. In some embodiments, the supporting surface of the platen 68 and/or the clamping surface of the clamp plate 74 has applied thereto a rubber layer, sandpaper-like grit layer, compliant (e.g. foam) layer or other high-friction material.

The clamp plate 74 may be omitted in some embodiments (not shown), such as where the supporting surface of the platen 68 is sufficiently non-slip. An unclamped version (not shown) of the document transport system 60 advantageously permits edge-to-edge printing on all edges. In some embodiments, the document transport system 60 includes vacuum-producing members such that the platen 68 is operable to maintain contact with a supported document by vacuum pressure.

Figure 7:
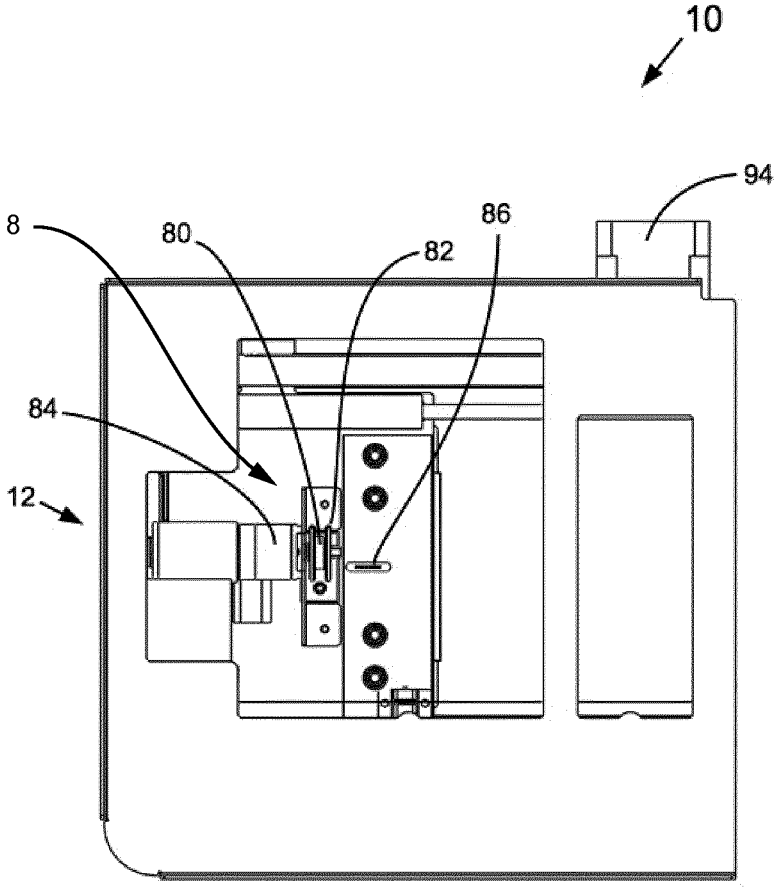
FIG. 7 is a view from below of a printer according to an embodiment with the outer casing removed in order to show the inter-level document transport mechanism in more detail.
Figure 8:
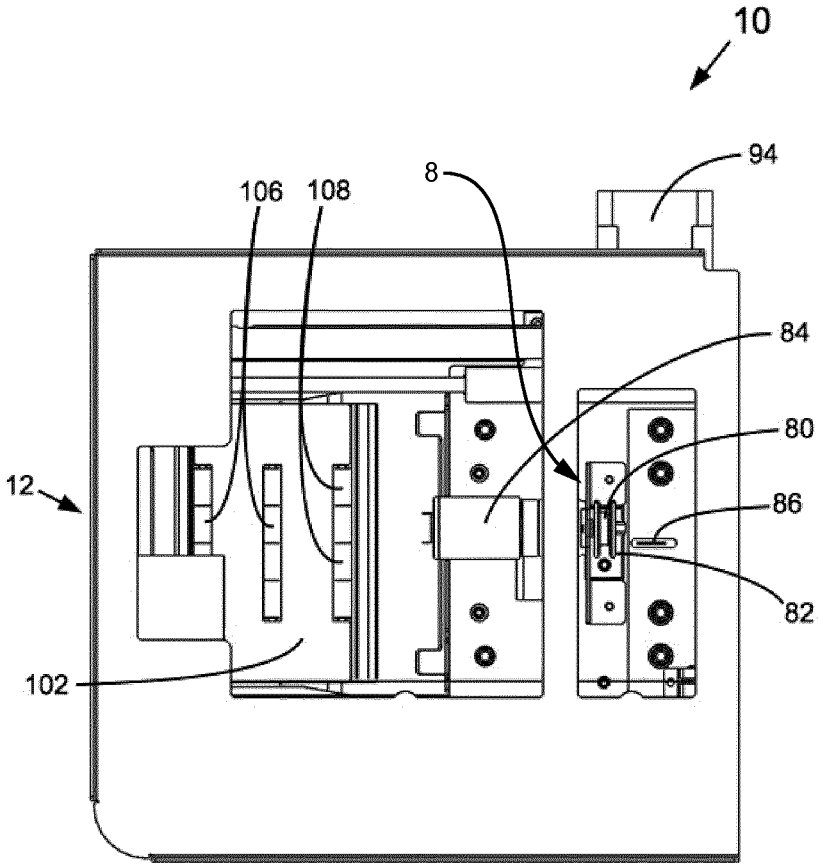
FIG. 8 is a view from below of the printer illustrated in FIG. 7 with the inter-level document transport mechanism moved by the intra-level document transport mechanism to a position away from the inlet of the printer.

FIGS. 7 and 8 show, by bottom views of the printer 10, a clamp belt 80 connected at one end to a clamp pulley 82 attached to the output shaft of a clamp motor 84.

Figure 9:
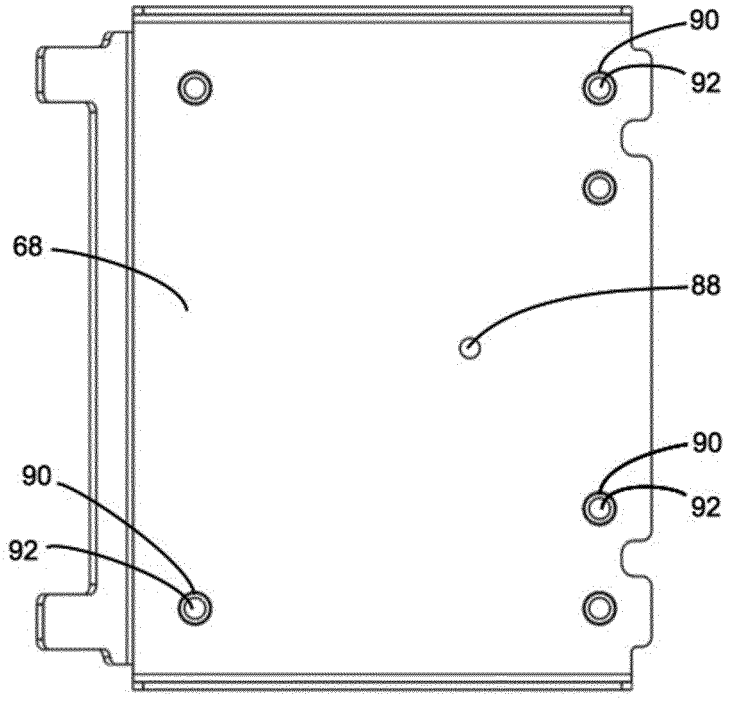
FIG. 9 is a detailed view of the document receiving platen from below.

As best seen in FIG. 9, the other end of the clamp belt 80 is connected to the platen 68 at a balance point 88 located on the bottom side of the platen 68. Springs 90 are disposed around preferably vertical alignment posts 92. The springs 90 extend between the bottom side of the platen 68 and the frame 62 to urge the platen 68 into its upper, clamping position. When the clamp motor 84 is energized, the clamp pulley 82 is rotated to wind up the clamp belt 80 so as to move the platen 68 preferably vertically toward its lower, non-clamping position.

The document transport system 60 (FIG. 3) includes a platen sensor 86 (FIGS. 7 and 8) for sensing when the platen 68 has arrived at its lower position, thereby advantageously permitting the clamp motor 84 to consume less power when maintaining the platen 68 in its lower position than is initially consumed to bring the platen 68 to its lower position. When the clamp motor 84 is de-energized, the platen 68 returns to its upper, clamping position by the force of the springs 90. In the embodiment shown in FIGS. 7 to 9, the use of the clamp belt and the clamp pulley 82 efficiently converts vertical, translational motion of the platen 68 to a rotational movement, thereby advantageously reducing the overall height of the printer 10 such that the printer 10 is compact.

While FIGS. 7 to 9 show an embodiment in which springs 90 urge the platen 68 upward while energizing the clamp motor 84 moves the platen 68 downward against the springs 90 pressure, other arrangements are possible. For example, springs may be employed to urge the platen 68 downward and a motor move the platen 68 upward against spring pressure. As a further example, a motor may be employed to positively move the platen 68 both upward and downward, either in the absence of spring pressure or against bi-directional spring pressure for example.

In the embodiment shown in FIG. 9, there are four springs 90 located beneath the clamp plate 74 (FIGS. 5 and 6) and two springs 90 located at the opposite end of the platen 74. The balance point 88 is defined as the point along the bottom side of the platen 68, when the platen 68 is being pulled down by the clamp belt 80, where uniform downward pressure is applied to the platen 68 so as to minimize any rotation during downward translation of the platen 68. In the case where six springs 90, each having substantially the same spring constant, are disposed at the locations shown in FIG. 9, the balance point 88 is located one-third the longitudinal distance from the four-spring end to the two-spring end of the platen 68, and is centrally located in the transverse direction. Connecting the clamp belt 80 to the platen 68 at the balance point advantageously minimizes uneven wear on the posts 92 and the frame 62, and advantageously minimizes the likelihood of the platen 68 becoming jammed in the frame 62.

Referring back to FIGS. 4 to 6, the document transport system 60 is operable to move the platen 68 and clamp plate 74 horizontally and longitudinally (i.e. closer or farther from the inlet 12 using the intra-level transport system). When the passport 70 is clamped between the platen 68 and the clamp plate 74, moving the platen 68 and clamp plate 74 longitudinally also moves the passport 70 longitudinally. A motor, such as the stepper motor 94, is operable to rotate a motor-output gear (not visible in the Figures) that engages an endless belt 96 of the intra-level transport system as linear transfer mechanism. As described above, other means may be used to transform the rotary movement of the motor to a linear movement for the intra-level transport mechanism.

The endless belt 96 engages the transport pulley 98, and the platen 68 is attached at one point to the endless belt 96 by a belt attachment 100. When the stepper motor 94 rotates its output gear, the endless belt 96 is moved about the output gear and the transport pulley 98, which causes the belt attachment 100 to move longitudinally within the limits of its travel between the stepper motor 94 and the transport pulley 98, thereby causing the platen 68 and the clamp plate 74 to move longitudinally.

In the embodiments shown in the Figures, the printer 10 is advantageously operable to effect vertical movement of the platen 68 independently of effecting horizontal movement of the platen 68 using the inter-level transport mechanism.

While FIGS. 4 to 9 show pulley-and-belt implementations of the document transport system 60 for horizontal and vertical movement, in general any suitable implementation (s) are possible. For example, horizontal and/or vertical movement associated with the document transport system 60 may be implemented by a rack-and-pinion mechanism (not shown), a linear motor (not shown), linear actuator (not shown), solenoid (not shown), transducer (not shown) or other mechanism capable of producing reversible linear motion of the platen 68. For vertical motion, the platen 68 itself may form an integral component of a linear motor or solenoid, for example.

Referring to FIGS. 4, 6 and 8, an upper entry guide 102 is rotatably connected to the frame 62 at a hinge 104 disposed at a distance inward of the top of the inlet 12. The upper entry guide 102 is freely rotatable and preferably contacts a document, such as the passport 70, by force of gravity only. The upper entry guide 102 advantageously facilitates flattening of a document being inserted into the printer 10. As best seen in FIG. 8, the upper entry guide 102 includes rollers 106 to reduce friction between the upper entry guide 102 and any document being inserted into the printer 10. In the embodiment shown in FIG. 8, each roller 106 is comprised of four collinear roller segments 108. However, in general, each roller 106 may be made of any number of roller segments 108, including a given roller 106 being made of one single roller segment 108 for example. Different rollers 106 may be made of a different number of roller segments 108, and different roller segments 108 may have different sizes. In general, any number of rollers 106 may be employed.

In the embodiments shown in FIGS. 3 to 9, the document transport system 60 includes a fail-safe feature such that if electrical power to the printer 10 is interrupted or if certain operational errors are detected by the printer 10, the document transport system 60 returns the platen 68 to the unclamped position such that any document inside the printer 10 can be manually removed from the printer 10 without damaging the document. In case of springs with a bias towards the clamping position (processing level), such a fail-safe feature may employ an energy storage such as a battery in order to be able to move the document receiving platen 68 to the level of the inlet 12 (access level). The fail-safe feature may also comprise locking means for keeping the document receiving platen 68 on the access level. Preferably and in relation to the fail-safe feature, the clamping mechanism of the printer 10 still allows an operator to pull the official document free without causing damage to that document.

In some embodiments, the printer 10 is operable to lock the position of the platen 68 so that it is immovable. For example, the printer 10 may be operable to lock the position of the platen 68 when the printer 10 is being shutdown, thereby advantageously preventing movement of the platen 68 during shipping and handling of the printer 10, for example.

Figure 10:
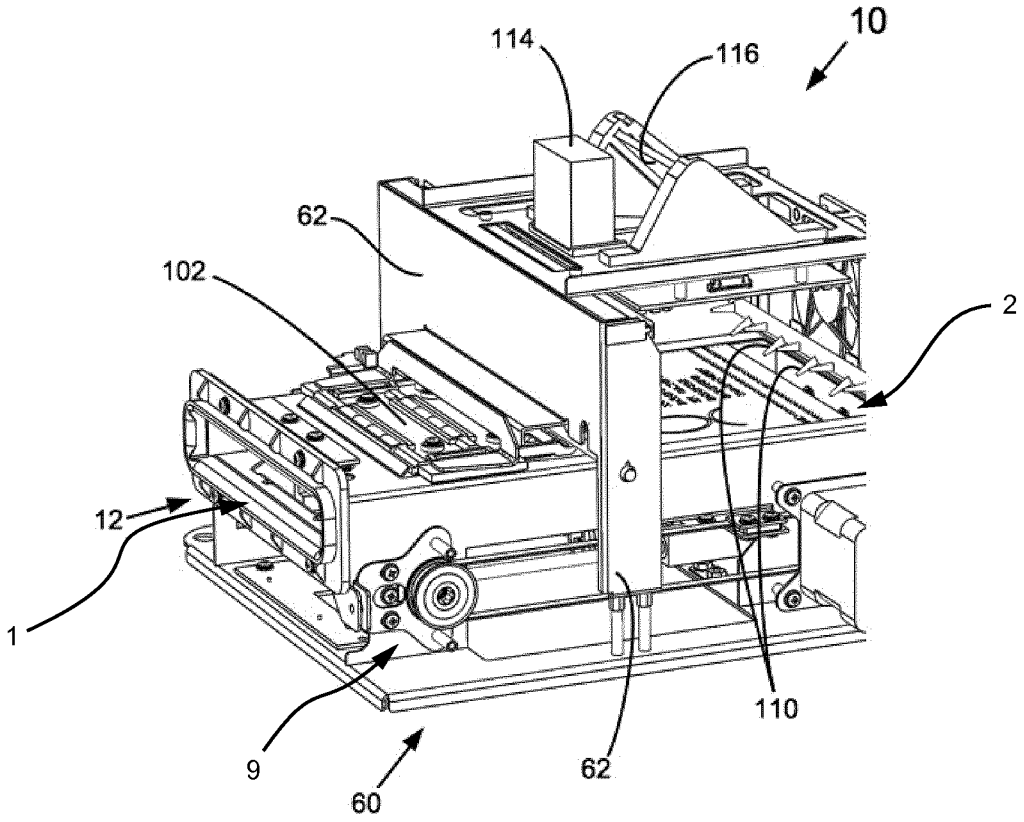
FIG. 10 is a partial three-dimensional side view of an embodiment of the printer in an oblique angle from the front of the printer.

In some embodiments (not shown), the document transport system 60 does not include the clamp plate 74, but has other means of positioning a document, such as the passport 70, for printing and imaging. For example, FIG. 10 shows an alternative embodiment that differs from previous embodiments due to air nozzles 110 for blowing air (e.g. compressed air) onto the passport 70 to flatten the exposed top surface of the document during printing and imaging in the absence of clamping. Various air nozzles 110 disposed at different locations may be employed. For example, air nozzles 110 may be disposed centrally or near-centrally above the printing position and pointing downwardly toward one or more edges of the platen 68. The angles of the air nozzles 110 may be adjustable, including being user-adjustable and/or automatically adjusting. In some embodiments (not shown), both the clamp plate 74 and one or more air nozzles may be employed.

In some embodiments (not shown), the document transport system 60 does not include the platen 68, but has other means of positioning a document, such as the passport 70, for printing and imaging. For example, the document transport system 60 may include one or more vacuum-producing cups that attach to the document, such as near the edges and/or corners of the document, to hold the document in place in the absence of a support such as provided by the platen 68.

Referring back to FIG. 3, the printer 10 includes an imaging system 112 for capturing still and/or video images of a document, such as the passport 70 (FIG. 6), when the platen 68 is in its imaging position.

FIG. 4 shows according to a preferred embodiment of the invention a camera 114 disposed atop the frame 62 at a distance from an angled flat mirror 116 for reflecting light from a clamped document, such as the passport 70, toward the camera 114 when the platen 68 is in its imaging position. The use of the mirror 116 increases the distance light travels between the passport 70 being imaged and the camera 114. Such increased distance advantageously increases the field of view of the camera 114 to sufficiently encompass one page of the opened booklet of a standardized passport 70 without the need for a wide-angle lens, which can cause image distortion, and without needing to increase the overall height of the printer 10. Thus, the mirror 116 arrangement shown in FIG. 4 advantageously assists in rendering the printer 10 compact.

In variations, the mirror 116 may be oriented at any suitable angle and have any suitable size. For example, the camera 114 and the mirror 116 may be rotated 180 degrees from that shown in FIG. 4, such that the mirror 116 is closer to the inlet 12 than the camera 114. Other arrangements are possible. For example, a plurality of flat mirrors 116 may be employed to permit a range of dispositions of the camera 114, including possibly installing the camera 114 underneath or otherwise below the platen 68, to the side of the platen 68, or in other locations and positions.

The position, including angle, of the mirror 116 is adjustable in some embodiments. The position and/or angle of the mirror 116 may be adjusted during factory calibration, for example.

Figure 11:
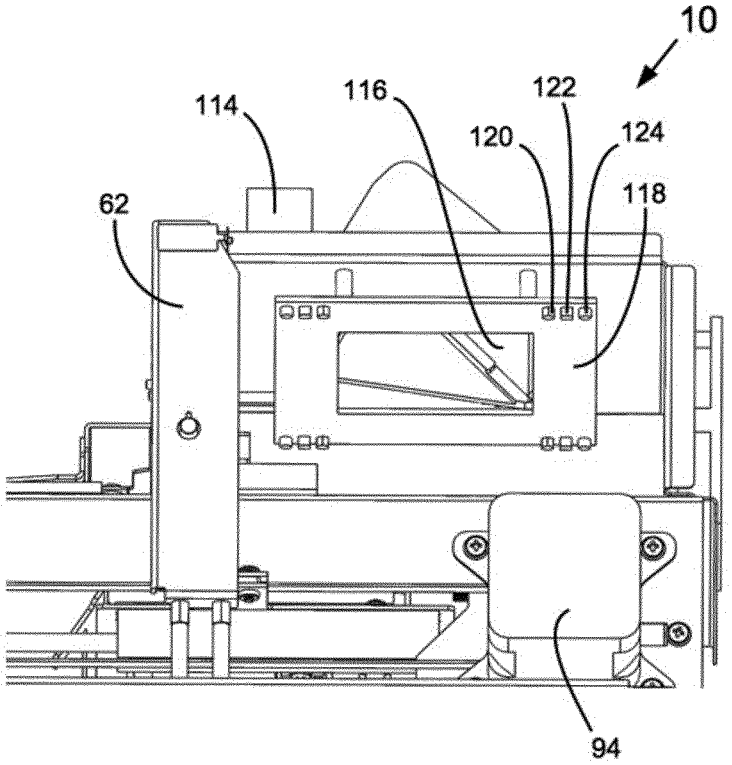
FIG. 11 is a partial three-dimensional side view of an embodiment of the printer in an oblique angle from below showing the illumination unit of the printer in more detail.

FIG. 11 shows an illumination bar 118 disposed below the portion of the frame 62 dimensioned for supporting the camera 114 and the mirror 116 according to another preferred embodiment of the invention. The illumination bar 118 is operable to illuminate a clamped document, such as the passport 70, when the platen 68 is in its imaging position. The illumination bar includes a plurality of sources, which in various embodiments may include any one or more of visible light sources 120, ultraviolet (UV) sources 122 and infrared (IR) sources 124 for example. Other sources of electromagnetic radiation emitting any suitable wavelengths or ranges thereof, including laser and x-ray sources for example, are possible. Embodiments employing lasers advantageously permit imaging of specific, small-sized features of the clamped document and/or features embedded within the substrate material of the clamped document.

For embodiments of the illumination bar 118 employing sources producing electromagnetic radiation that might be harmful to humans or otherwise harmful, the exterior body and/or frame 62 may incorporate additional shielding to prevent harmful radiation from leaking out of the printer 10 on top of the configuration of an access level and a processing level that are at least partly arranged on top of each other. Such additional shielding may include an entry door (not shown), such as a spring-loaded or otherwise swing-type entry door, for covering the inlet 12 (FIG. 1) when a document is not being inserted therethrough.

In some embodiments, one or more illumination bar 118 sources produce electromagnetic radiation (e.g. UV) and/or heating to assist in drying and/or curing ink, such as a SICPA™ security ink, that has been printed on a document, such as the passport 70.

In some embodiments, optical components (not shown), such as mirrors, lenses and/or baffles, may be employed to improve the uniformity of lighting provided by the illumination bar 118, and/or reduce the possibility of the camera 114 itself appearing in the images captured by the camera 114.

Referring back to FIG. 3, the printing system 38 in some embodiments is operable to cause the printer 10 to transmit image data captured by the camera 114 to the main processor 40, which is operable to transmit such image data, via the communications module 48 and the PC communications module 52, to the PC processor 54 for display on the PC display 58, for example.

The printer 10 also includes a print-head system 126 for printing on a document, such as the passport 70 (FIG. 6) when it is clamped at its leading edge 76 by the document transport system 60 and the platen 68 is in a printing position. The print-head system 126 includes a print head 128 (FIG. 5), which in the exemplary embodiment shown in FIG. 5 is an inkjet print head 128, for printing in a known manner.

Referring to FIGS. 4 to 6, when the platen 68 is in its imaging position, the camera 114 is operable to capture an image of the page that is adjacent the leading edge 76 of the opened booklet of the standardized passport 70. However, in some embodiments, the printer 10 is dimensioned to permit the camera 114 to also capture an image of the trailing page of the opened booklet by moving the platen 68 beyond the first imaging position to a second imaging position. In some embodiments, the printer 10 is dimensioned to permit the camera 114 to capture an image of the entire opened booklet. The printer 10 may be lengthened, for example, to sequentially or simultaneously accommodate both exposed pages of the opened booklet.

Attached to the print head 128 is a replaceable ink cartridge that can ordinarily be accessed via the door 18 (FIG. 1). In the embodiment shown in FIG. 5, the print head 128 is operable to receive one or more ink cartridges containing security ink, and is operable to print using security ink. Such security ink may be a SICPA™ security ink, for example.

The print-head system 126 is operable to perform a print initialization routine, such as before printing. In some embodiments, the printer 10 is operable to initiate the print initialization routine as soon as the presence of a document, such as the passport 70, is detected by the entry sensor 64 (FIG. 4), thereby advantageously minimizing delay upon initiating any subsequent printing operation.

Method of Operation

Figure 12:
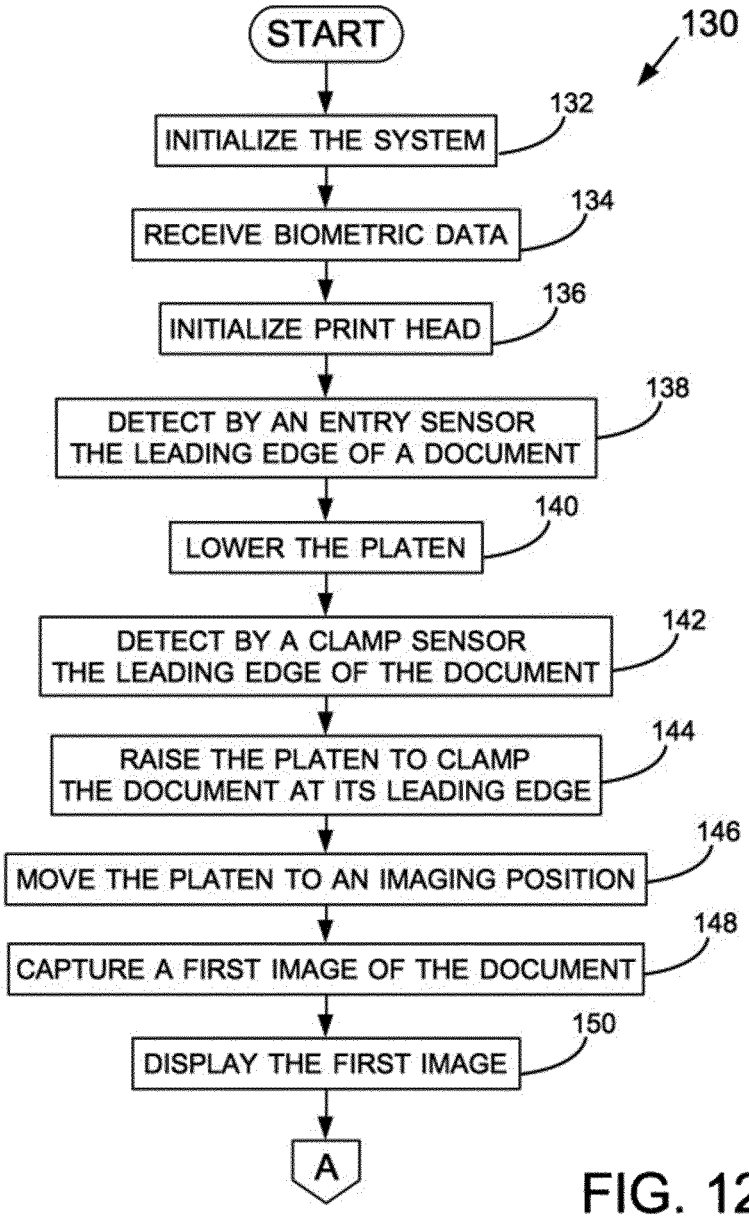
FIG. 12 is a flow diagram illustrating the first part of a method according to an embodiment for applying a stamp to an official document.
Figure 13:
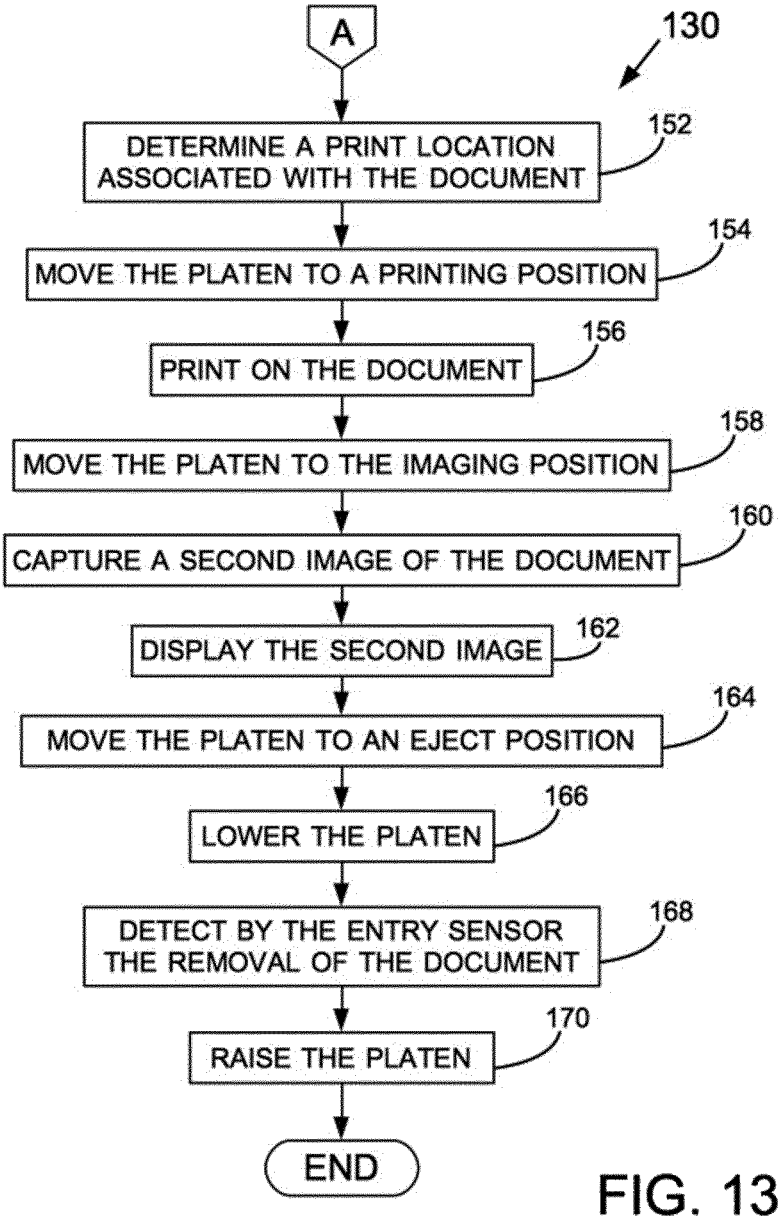
FIG. 13 is a flow diagram illustrating the second part of the method following the method steps shown in FIG. 12.

Referring to FIGS. 3, 12 and 13, the memory 42 and the PC memory 56 in accordance with embodiments of the invention each contain codes comprising computer executable instructions for directing the main processor 40 and the PC processor 54 of the printing system 38 to perform steps of a method shown generally at 130, respectively. Additionally or alternatively, the blocks of code may form part of a computer program product comprising computer executable instructions embodied in a recordable computer readable medium, for example.

When electrical power is being supplied to the main processor 40, memory 42, PC processor 54 and the PC memory 56 of the printing system 38, the main processor 40 and the PC processor 54 are directed by respective portions of the block of codes 132 to initialize the printing system 38. For example, respective portions of block 132 direct the main processor 40 and the PC processor 54 to establish communications between the printer 10 and the PC 50. Block 132 in some embodiments also directs the main processor 40 to perform an initialization test of the document transport system 60, i. e. the inter-level document transport system and the intra-level document transport system, such as by moving the platen 68 through its range of motion for example.

When block 132 has been executed, the main processor 40 is directed by block 134 to receive biometric data from the biometric reader module 44. Receiving biometric data typically involves waiting for the biometric reader module 44 and/or its fingerprint scanner 16 (FIG. 1) to detect an object, such as an operator's finger, adjacent the fingerprint scanner 16 window. When an object appears, the fingerprint scanner 16 reads the object and the biometric reader module 44 transmits biometric data to the main processor 40. Block 134 may direct the main processor 40 to store the biometric data in the memory 42, display the biometric data on the display 20 (FIGS. 1 and 2) and/or transmit the biometric data to the PC processor 54. Block 134 may direct the PC processor 54 to receive the biometric data, store it in the PC memory 56 and/or display the biometric data on the PC display 58.

Block 134 may also direct either or both the main processor 40 and the PC processor 54 to receive further user input, such as a user identification and user pass code, as part of a login operation for an operator (e.g. government Official) of the printing system 38. Block 134 may direct the printing system 38 processors to enable further operations only if the login operation is successfully completed, for example.

Block 136 directs the main processor 40 to initialize the print head 128. Initializing the print head 128 typically involves moving the print head 128 through a range of its motion and/or ejecting a test amount of ink, for example, as is known in the art. While the method 130 shows block 136 being executed immediately after block 134, in general block 136 may be executed at any suitable time before printing, including performing the operations of block 136 when executing block 132. In some embodiments, block 136 is executed in parallel with other blocks, such as any of the blocks 138 to 160 described herein below.

Block 138 directs the printer 10 to detect by the entry sensor 64 (FIG. 4) the leading edge 76 (FIG. 6) of a document. Detecting the leading edge 76 typically involves waiting for such event to occur, and directing a processor (not shown) of the document transport system 60 to receive from the entry sensor 64 an indication of the presence of the document at the inlet 12 (FIG. 1). In a typical scenario, the document is the passport 70 (FIG. 6) or similar.

When the leading edge 76 has been detected at the inlet 12 (FIG. 1) by executing block 138, block 140 then directs the printer 10 to lower the platen 68 (FIG. 5) to its lower position using the inter-level transport system 8. In the embodiments shown in the Figures, block 140 directs a document transport system processor (not shown) to energize the clamp motor 84 (FIGS. 7 and 8) of the inter-level transport system 8 to rotate the clamp pulley 82 to pull down on the clamp belt 80 to pull down the platen 68 toward its lower position, i. e. access level, until the document transport system processor receives from the platen sensor 86 an indication that the platen 68 has arrived at its lower position.

Block 142 directs the printer 10 to detect by the clamp sensor 78 (FIG. 6) the leading edge 76 of the document. Executing block 142 typically involves waiting for the leading edge 76 to be manually pushed past the entry sensor 64 (FIG. 4) until it reaches the clamp sensor 78 (FIG. 6). When the clamp sensor 78 detects the leading edge 76 of the document, block 142 directs the document transport system 60 processor to receive from the clamp sensor 78 an indication of the presence of the detected leading edge 76.

Block 144 directs the printer 10 to raise the platen 68 (FIG. 5) to its upper clamping position, i. e. processing level, to clamp the document at its leading edge 76 (FIG. 6). In the embodiments shown in the Figures, block 144 directs the document transport system processor to de-energize the clamp motor 84, thereby allowing the clamp pulley 82 to freely unwind and release tension on the clamp belt 80 so that the platen 68 returns toward its upper position under pressure from the springs (FIGS. 1 and 9). The platen 68 is moved toward its upper position until the leading edge 76 of the document contacts the underneath of the clamp plate 74 (FIG. 6), thereby clamping the document.

Block 146 directs the printer 10 to move the platen 68 (FIG. 5) to its imaging position. In the embodiments shown in the Figures, block 146 directs the document transport system processor to cause the platen 68 to be moved from its printing position (i.e. the original position of the platen 68 when the document is received into the printer 10) to its imaging position. Doing so moves the document, such as the passport 70, into position for being imaged by the camera 114 (FIG. 4). In some embodiments, the document is initially received into the printer 10 when the platen 68 is in its imaging position such that block 146 may be omitted.

Block 148 directs the printer 10 to capture a first image of the document, such as the passport 70 (FIG. 6). In the embodiments shown in the Figures, block 148 directs the imaging system 112 processor to cause the camera 114 (FIG. 4) to capture the first image. In some embodiments, the camera 114 is directed to capture a plurality of images, such as different images under different illuminations (e.g. visible light, UV, IR, combinations thereof, etc.) by the illumination bar 118 (FIG. 11). In some embodiments, the camera 114 is directed to capture a sequence of video images. In some embodiments, capturing the first image involves storing the first image (or sequence of video images) in memory, such as the memory 42 or memory of a central database for example. Storing the first image in the memory of a central database typically involves transmitting the first image via a network to such central database.

The at least one image taken by the camera 114 may be used to verify at least parts of an official documents, to perform quality control of a printed stamp and/or to perform self-calibration. Further, the at least one image may be employed for data logging purposes, for data mining purposes and/or for profiling purposes.

Block 150 directs the printing system 38 to display the first image. In variations, the first image may be displayed on the display 20 of the printer 10, on the PC display 58, or on both the display 20 and the PC display 58. Displaying the first image on the display 20 may involve directing the imaging system 112 processor to transmit image data associated with the first image to the display module 46 processor, possibly via the main processor 40; directing the display module 46 processor to receive such image data; and directing the display module 46 processor to cause the display 20 to display the image data as the first image, for example. Displaying the first image on the PC display 58 may involve directing the imaging system 112 processor to transmit image data associated with the first image to the PC processor 54, via the communications modules 48 and 52, and possibly also via the main processor 40; directing the PC processor 54 to receive such image data; and directing the PC processor 54 to cause the PC display 58 to display the image data as the first image, for example.

In some embodiments, displaying the first image on the display 20 and/or PC display 58 involves superimposing on the first image a dotted-line image or other ghosted image of a stamp available for printing on the document, such as the passport 70. In some embodiments, displaying the first image comprises displaying a plurality of images, or a single composite derived therefrom, captured in response to different illuminations (e.g. visible light, UV, IR, combinations thereof, etc.) produced by the illumination bar 118 (FIG. 11).

The printing system 38 is operable to print dynamic stamps comprising stamp data dynamically generated during official processing of the passport 70 and its holder, including stamp data generated immediately prior to printing the dynamic stamp by the printing system 38. Printing dynamic stamps advantageously permits the Visa stamp being printed on the passport 70 to include variable data such as the date of entry into or exit from a given country; time of entry or exit; location of entry or exit (e.g. airport name and gate number); airline flight number associated with the entry or exit; the type of Visa granted (e.g. visitor or working Visa); the passport 70 holder's entitlement to specified government benefits during a permitted stay within the given country; maximum permitted length of stay; passport 70 holder's identity, including biometrics and biographics associated with the passport 70 and/or associated with the passport 70 holder; passport 70 number; passport 70 expiry date; purpose of stay; all or a portion of the passport 70 holder's travel history; a government Official's interview notes; additional comments by the government Official; or other information. Generally, the stamp data also includes static template data such as the graphic image associated with a particular Visa stamp of a given country. Printed stamp data may be encoded, such as in the form of a bar code for example.

Block 152 directs the printing system 38 to determine a print location associated with the document, such as the passport (FIG. 6). In exemplary embodiments, determining the print location involves receiving user input identifying a region of the passport 70 where it is desired to print the stamp/visa. Typically, stamps/visa are printed so that a newly printed Visa stamp does not overlap any existing stamp.

In one embodiment, the printing system 38 is operable to display on the display 20 and/or the PC display 58 a plurality of enumerated regions, such as six regions enumerated one to six, for selection by the operator. For example, block 152 may direct the display module 46 processor to receive as user input via the touchscreen display 20 a selection of one of the displayed regions. In a variation, block 152 may direct the PC 50 to receive as user input a selection of a region displayed on the PC display 58.

In some embodiments, the printing system 38 is operable to receive as user input coordinates of a print location. For example, block 152 may direct the PC 50 to permit the operator to move and/or rotate a ghosted image of a Visa stamp to a desired position and then receive as user input the location, including possibly rotational angle, that the operator has selected for printing.

In some embodiments, the printing system 38 is operable to receive as user input an indication of a magnification factor so as to alter the overall size of the visa stamp when printed, such that determining the print location advantageously involves determining a magnification factor associated with the print location.

In some embodiments, determining the print location involves executing automated processing to determine the print location, including possibly rotation angle and magnification, without receiving as user input a selection of a print location. Such automated determination may be in accordance with national or international laws and standards. Executing such automated processing may involve computerized image processing to determine blank areas of the passport 70 that are visible in the first image, and automatically determining a print location, including possibly rotation angle and magnification, within one such blank area.

Block 154 directs the printer 10 to move the platen 68 (FIG. 5) to its printing position. Directing the printer 10 to move the platen 68 to its printing position involves directing the document transport system processor to move the platen 68 longitudinally, such as by operation of the stepper motor 94, to its printing position beneath the print head 128.

Block 156 directs the printing system 38 to print on the document, such as the passport 70 (FIG. 6). Printing on the document may involve any one or more of transmitting stamp data from the PC 50 to the printer 10; transmitting the print location, including possibly rotation angle and magnification, from the PC 50 to the printer 10; directing the print-head system 126 to print on the document in accordance with the stamp data and print location; directing the document transport system 60 to move the platen 68 longitudinally using the intra-level document transport system 9 with each new line being printed; and directing the print-head system 126 to move the print head 128 (FIG. 5) transversely during the printing of each print line.

Block 158 directs the printer 10 to move the platen 68 (FIG. 5) to its imaging position. Block 158 may be implemented in a manner that is similar to the implementation of block 146 described herein above, for example.

In some embodiments, the platen 68 is moved by the intra-level transport system 9 for printing each print line in the longitudinal direction (e.g. away from the inlet 12) such that the platen 68 arrives at its imaging position when printing is completed. In such embodiments, block 158 may be omitted.

Block 160 directs the printer 10 to capture a second image of the document, such as the passport 70 (FIG. 6). Block 160 may be implemented in a manner that is similar to the implementation of block 148 described herein above, for example. Capturing a second image, a second set of images under the same or different illuminations, or capturing a video sequence advantageously permits image(s) of the page upon which a Visa stamp has been printed to be stored for future reference, analyzed for quality control purposes, archived, otherwise made available, and any combination thereof for example.

Block 162 directs the printing system 38 to display the second image. Block 162 may be implemented in a manner that is similar to the implementation of block 150 described herein above, for example.

In some embodiments, blocks 158 and 160, and possibly block 162, are omitted and the method 130 proceeds directly from block 156 to block 162 or 164.

Block 164 directs the printer 10 to move the platen 68 (FIG. 5) to its eject position. In the embodiments shown in the Figures, the eject position coincides longitudinally with the initial position of the platen 68 on the access level 1 prior to the document, such as the passport 70 (FIG. 6), being inserted into the printer 10.

Block 164 may be omitted in embodiments (or user settings) in which blocks 160 and 162 are omitted and the printer 10 prints each print line in the longitudinal direction toward the inlet 12 such that the platen 68 arrives at its eject position when printing is completed.

In embodiments having heaters, such as heating elements (not shown) on the illumination bar 118 (FIG. 11) or associated with the platen 68, and/or electromagnetic radiation (e.g. UV) sources to heat and/or cure the ink after it has been printed on the document, such heaters and/or radiation sources may be energized by executing any one or more of blocks 158 to 164, for example. Additionally or alternatively, the air nozzles 110 (FIG. 10) may be employed to blow air to assist drying and/or curing of printed ink. Air may be blown at a rate that is high enough to assist with drying and/or curing, but not so high as to smear or spread wet ink. The speed at which the platen 68 is moved (e.g. moved towards its eject position by block 164) may depend on a speed of drying associated with the ink printed on the document and the document (e.g. paper type) itself, for example.

Block 166 directs the printer 10 to lower the platen 68 (FIG. 5). Lowering the platen 68 unclamps the document, such as the passport 70, so that it can be manually removed from the printer 10, such as by the operator. Block 166 may be implemented in a manner that is similar to the implementation of block 140 described herein above, for example.

Block 168 directs the printer 10 to detect by the entry sensor 64 (FIG. 4) the removal of the document, such as the passport 70 (FIG. 6). Block 168 may be implemented in a manner that is analogous to the implementation of block 138 described herein above, except that the entry sensor 64 transmits to the document transport system 60 processor an indication of the absence of any object at the inlet 12 (FIG. 1).

Block 170 directs the printer 10 to raise the platen 68 (FIG. 5). Block 170 may be implemented in a manner that is analogous to the implementation of block 144 described herein above, except that the platen 68 will move fully to its upper position on the processing level if not clamping a document. Raising the platen 68 by de-energizing the clamp motor 84 advantageously reduces power consumption of the embodiment shown in FIGS. 5 to 9.

While the blocks 132 to 170 are shown in an exemplary order in FIGS. 12 and 13, various steps of the method 130 may be performed in any suitable order. For example, transmitting stamp data from the PC 50 to the printer 10 may occur at any time prior to printing on the document and executed by any block 132 to 156, for example. Similarly, transmitting the print location may be executed by any block 152 to 156 for example.

In the embodiment shown in FIGS. 12 and 13, the printing system 38 is operable to cause the printer 10 to notify the PC 50 of various events, such as the completion of an operational task. For example, block 132 may direct the printer 10 to notify the PC 50 that the printer 10 has completed its initialization, or portions thereof. Block 134 may direct the printer 10 to notify the PC 50 that the biometric data has been received. Block 136 may direct the printer 10 to notify the PC 50 that the print head 128 (FIG. 4) has been initialized. Similarly, the printer 10 may be directed to notify the PC 50 of the completion of any one or more of blocks 138 to 170, or portions thereof.

While the printer 10 is described herein as comprising a plurality of processors, in some embodiments the main processor performs all of the functions of all of the printer 10 processors described herein. In some embodiments, the one or more printer 10 processors are operable to perform all of the functions of the PC 50 that are described herein, such that the printer 10 is operable to perform in a stand-alone mode. In embodiments in which one or more printer 10 processors perform all of the functions of the PC 50, then the printer 10 would not ordinarily notify the PC 50 of the completion of its tasks. In variations, any one or more of the steps of the method 130 may be under the control of either the main processor 40 or the PC processor 54.

In some embodiments, the printer 10 is operable to track its geographical location, such as by a global position system (GPS), and to determine whether it has been moved outside of a pre-determined (e.g. user specified) geographical area. Additionally or alternatively, the printer 10 may be operable to detect tampering or other unauthorized handling of the printer 10. Upon determining that the printer 10 has been moved outside of a permitted geographical area or that unauthorized handling has occurred, the printer 10 may perform any one or more of signaling or sounding an alarm, communicating an alert to a central administrator device via a network (e.g. Internet, telecommunications network, etc.), disabling its operation, or other actions for example.

REFERENCE SIGNS

| | |
|---|---|
| Access level | 1 |
| Processing level | 2 |
| inter-level transport system | 8 |
| intra-level transport system | 9 |
| printer | 10 |
| inlet | 12 |
| exterior body | 14 |
| fingerprint scanner | 16 |
| door | 18 |
| display | 20 |
| soft buttons | 22 |
| power switch | 24 |
| type-A USB receptacle | 26 |
| type-B USB receptacle | 28 |
| power input receptacle | 30 |
| Kensington (TM) Security Slot | 32 |
| fan door | 34 |
| latch | 36 |
| printing system | 38 |
| main processor | 40 |
| main memory | 42 |
| biometric reader module | 44 |
| display module | 46 |
| communications module | 48 |
| connected PC | 50 |
| PC communications module | 52 |
| PC processor | 54 |
| PC memory | 56 |
| PC display | 58 |
| document transport system | 60 |
| frame | 62 |
| entry sensor | 64 |
| printed circuit board (PCB) | 66 |
| document receiving platen | 68 |

-continued

| REFERENCE SIGNS | |
|---|---|
| passport | 70 |
| top surface | 72 |
| clamp plate | 74 |
| leading edge | 76 |
| clamp sensor | 78 |
| clamp belt | 80 |
| clamp pulley | 82 |
| clamp motor | 84 |
| platen sensor | 86 |
| balance point | 88 |
| springs | 90 |
| posts | 92 |
| stepper motor | 94 |
| endless belt | 96 |
| transport pulley | 98 |
| belt attachment | 100 |
| upper entry guide | 102 |
| hinge | 104 |
| rollers | 106 |
| roller segments | 108 |
| air nozzles | 110 |
| imaging system | 112 |
| camera | 114 |
| mirror | 116 |
| illumination bar | 118 |
| visible light sources | 120 |
| ultraviolet (UV) sources | 122 |
| infrared (IR) sources | 124 |
| print-head system | 126 |
| print head | 128 |
| method | 130 |
| blocks | 132 to 170 |

The invention claimed is:

1. A printer for applying a stamp onto an official document, the printer comprising:

an access level with an inlet for inserting the document into and removing the document from the printer, a processing level including a print head, and an inter-level document transport system for moving a document receiving platen between a lower position corresponding to the access level and an upper position corresponding to the processing level such that when the document receiving platen is in the lower position, the top surface of the document receiving platen is substantially aligned with or lower than the bottom of the inlet, and when the document receiving platen is in the upper position, the top surface of the document receiving platen is substantially aligned with the top of the inlet, wherein the access level and the processing level are at least partly arranged on top of each other, characterized in that the inter-level document transport system is a pulley mechanism comprising at least one pulley connected to a motor, and the inter-level document transport system includes at least one spring biasing the document receiving platen.

2. The printer according to claim 1, wherein the motor is a stepping motor.

3. The printer according to claim 1, wherein the at least one spring is adapted to bias the document receiving platen towards the processing level.

4. The printer according to claim 1, wherein the inter-level document transport system comprises a plurality of springs, wherein the pulley mechanism is attached to one attachment point at the document receiving platen, the attachment point being located between the springs.

5. The printer according to claim 1, further comprising an intra-level document transport system including a motor and a linear transfer mechanism, the linear transfer mechanism being connected to the document receiving platen via the inter-level document transport system.

6. The printer according to claim 5, wherein the document receiving platen has an edge facing the inlet for abutting the leading edge of the official document in the direction of insertion and a sensor for sensing the leading edge of the official document.

7. The printer according to claim 1, wherein the access level is located below the processing level.

8. The printer according to claim 1, wherein the platen comprises a clamping means configured to clamp the official document on the document receiving platen for processing the official document on the processing level.

9. The printer according to claim 1, wherein the printer further comprises an imaging system including a camera arranged for registering an image of the official document on the processing level.

10. The printer according to claim 9, wherein the imaging system further comprises a mirror arranged on an optical path between the camera and the platen.

11. The printer according to claim 1, further comprising an illumination unit arranged for illuminating the official document and/or treating a stamp applied to the document.

12. The printer according to claim 11, wherein the illumination unit comprises at least two different light sources.

13. The printer according to claim 1, further comprising an inlet light and/or an inlet sensor arranged at least partly around the inlet.

14. The printer according to claim 1, wherein the motor is a stepping motor or DC-motor.

15. The printer according to claim 1, wherein the linear transfer mechanism is a gear rack, a lead screw or an endless belt.

16. A method for processing an official document with the printer according to claim 1, the method comprising the steps of:

inserting an official document into the inlet on the access level of the printer and placing the document on the document receiving platen;

moving the official document on the document receiving platen from the lower position corresponding to the access level to the upper position corresponding to the processing level using an inter-level document transport system;

printing a stamp onto the official document;

moving the official document from the upper position corresponding to the processing level to the lower position corresponding to the access level for removal of the document from the inlet of the printer.

17. The method according to claim 16, further comprising the steps of registering an image of the official document using a camera and a mirror located on an optical path between the camera and the official document and processing the registered image for determining the location for a stamp and/or verifying a stamp.

18. The method according to claim 16, further comprising the step of moving the official document on the platen by an intra-level document transport system after insertion of the document into the inlet, before moving the document receiving platen with the inter-level document transport system.

19. The method according to claim 18, further comprising the step of moving the platen on the processing level using the intra-level document transport system while processing the document.

20. The method according to claim 16, wherein the step of printing a stamp comprises printing a dynamic stamp based on dynamically generated data.

* * * * *